US011000132B2

(12) United States Patent
Illers

(10) Patent No.: US 11,000,132 B2
(45) Date of Patent: May 11, 2021

(54) PRODUCT DISPLAY UNITS WITH PUSHERS

(71) Applicant: Display Technologies, LLC, Lake Success, NY (US)

(72) Inventor: Marty Illers, Yonkers, NY (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 16/569,245

(22) Filed: Sep. 12, 2019

(65) Prior Publication Data

US 2020/0085209 A1 Mar. 19, 2020

Related U.S. Application Data

(60) Provisional application No. 62/731,167, filed on Sep. 14, 2018.

(51) Int. Cl.
*A47F 1/12* (2006.01)
*A47F 5/00* (2006.01)

(52) U.S. Cl.
CPC ..... *A47F 1/126* (2013.01); *A47F 5/005* (2013.01); *A47F 5/0018* (2013.01); *A47F 5/0025* (2013.01)

(58) Field of Classification Search
CPC ..... A47F 1/126; A47F 5/0018; A47F 5/005; A47F 1/12; A47F 3/0486; A47F 5/0025; B65G 11/143; F25D 25/00; F25D 25/02
See application file for complete search history.

(56) References Cited

U.S. PATENT DOCUMENTS 3,501,016 A * 3/1970 Eaton ..... A47F 7/28 211/49.1
3,848,745 A * 11/1974 Smith ..... A47F 1/126 211/59.3
3,970,199 A 7/1976 Marschak
4,386,710 A * 6/1983 Dauman ..... A47F 1/125 211/59.3
4,478,337 A 10/1984 Flum
4,592,377 A * 6/1986 Paulsen ..... G07D 9/00 221/301
4,830,201 A * 5/1989 Breslow ..... A47F 1/126 211/184
5,027,957 A * 7/1991 Skalski ..... A47F 1/126 211/43
5,129,546 A * 7/1992 Thielmann ..... B65D 83/04 206/704
5,595,310 A 1/1997 Spamer et al.
(Continued)

FOREIGN PATENT DOCUMENTS

FR 2942590 9/2010
GB 2386116 A * 9/2003 ..... A47F 1/126
(Continued)

OTHER PUBLICATIONS

International Search Report and the Written Opinion for PCT/US2019/051023 dated Dec. 5, 2019.

*Primary Examiner* — Ko H Chan
(74) *Attorney, Agent, or Firm* — Andrus Intellectual Property Law, LLP

(57) ABSTRACT

A product display unit for displaying products includes a track defining a non-linear path and a pusher that moves along the non-linear path. The pusher is configured to move the products along the non-linear path.

16 Claims, 11 Drawing Sheets

(56) References Cited

U.S. PATENT DOCUMENTS

| | | | | |
|---|---|---|---|---|
| 5,743,428 | A * | 4/1998 | Rankin, VI | A47F 1/126 211/59.3 |
| 6,450,349 | B2 * | 9/2002 | Lee | B65G 11/143 211/175 |
| 6,464,089 | B1 | 10/2002 | Rankin, VI | |
| 6,502,408 | B1 | 1/2003 | Corcoran | |
| 6,523,703 | B1 * | 2/2003 | Robertson | A47F 1/126 211/51 |
| 6,655,536 | B2 * | 12/2003 | Jo | A47F 1/126 211/184 |
| 6,695,152 | B1 | 2/2004 | Fabrizio et al. | |
| 7,448,504 | B2 | 11/2008 | Primiano | |
| 7,802,697 | B2 | 9/2010 | Martin | |
| 8,453,850 | B2 * | 6/2013 | Hardy | A47F 1/126 211/184 |
| 8,543,850 | B2 | 6/2013 | Hardy | |
| 9,392,882 | B2 | 7/2016 | Pichel | |
| 9,622,594 | B2 | 4/2017 | Gommermann et al. | |
| 9,668,590 | B1 * | 6/2017 | Bruegmann | A47F 5/10 |
| 9,713,395 | B2 | 7/2017 | Pichel | |
| 9,949,577 | B2 | 4/2018 | Botta et al. | |
| 10,045,637 | B2 | 8/2018 | Akins | |
| 10,172,482 | B2 | 1/2019 | Pritchard | |
| 10,178,909 | B2 | 1/2019 | Hardy et al. | |
| 2010/0012602 | A1 | 1/2010 | Valiulis et al. | |
| 2011/0094980 | A1 | 4/2011 | Cousin et al. | |
| 2014/0151313 | A1 | 6/2014 | Breslow et al. | |
| 2015/0129521 | A1 | 5/2015 | Sun | |
| 2016/0236852 | A1 | 8/2016 | Albrecht | |
| 2016/0309920 | A1 | 10/2016 | Botta et al. | |
| 2016/0316936 | A1 | 11/2016 | Camello et al. | |
| 2017/0007040 | A1 | 1/2017 | Howard et al. | |
| 2017/0020303 | A1 * | 1/2017 | Atkins | A47F 1/125 |
| 2019/0014923 | A1 | 1/2019 | Robbins et al. | |

FOREIGN PATENT DOCUMENTS

| | | |
|---|---|---|
| GB | 2439624 | 1/2008 |
| JP | 2011056021 | 3/2011 |

* cited by examiner

PRODUCT DISPLAY UNITS WITH PUSHERS

CROSS-REFERENCE TO RELATED APPLICATION

The present disclosure is based on and claims priority to U.S. Provisional Patent Application No. 62/731,167 filed Sep. 14, 2018, the disclosure of which is incorporated herein by reference.

FIELD

The present disclosure relates to product display units for dispensing products, and specifically to product display units with pushers.

BACKGROUND

The following U.S. Patents are incorporated herein by reference in entirety.

U.S. Pat. No. 9,392,882 discloses a merchandising system for displaying a plurality of products. The system comprises a base and a pusher member. The base includes a product-supporting surface and a track disposed beneath the product-supporting surface. The base defines a longitudinal axis. The pusher member is disposed in mechanical cooperation with the base and is configured to slide longitudinally with respect to the base. The pusher member includes a base-contacting surface and a plurality of legs downwardly depending from the base-contacting surface. Each of the plurality of legs is configured to mechanically engage the track. The track includes a discontinuity to enable the legs of the pusher member to selectively mechanically engage the track.

U.S. Pat. No. 9,949,577 discloses a product display unit that includes a width extension with a first lateral sidewall, a second lateral sidewall, and a track. The first lateral sidewall is configured to releasably engage a sidewall of a product display member. The second lateral sidewall includes a first segment, a second segment, and a third segment. The second segment is parallel to the first lateral sidewall. The first segment is disposed at an angle with respect to the second segment. The third segment is disposed at an angle with respect to the second segment. The track is disposed between the first lateral sidewall and the second lateral sidewall. The track is configured to support products thereon.

U.S. Pat. No. 10,045,637 discloses a product display unit that includes a first track and a second track. The first track defines a longitudinal axis and is configured to support products thereon. The first track is configured to guide the products along the longitudinal axis. The second track is configured to support products thereon. A first portion of the second track is configured to guide the products in a first direction that is disposed at an angle with respect to the longitudinal axis. A second portion of the second track is configured to guide the products in a second direction that is parallel to the longitudinal axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a product display unit for displaying products includes a track defining a non-linear path and a pusher that moves along the non-linear path. The pusher is configured to move the products along the non-linear path.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DISCLOSURE

Conventional product display units are used in retail stores for dispensing products to customers. These product display units are located on shelving units, such as wire-form shelving units in refrigerators. Products, such as soda bottles, milk jugs, and juice cans, are positioned onto the product display unit and removed by a customer from the front of the product display unit such that other remaining products on the product display unit are moved, by gravity or a pusher, toward the front of the product display unit.

Certain product display units can be constructed to hold large quantities of frequently sold products and smaller quantities of infrequently sold products. In these examples, the product display unit includes one or more high-capacity tracks which hold a large quantity of frequently sold products. As such, the frequency at which the operator must restock the frequently sold products is reduced and the number of frequently sold products that are sold to customers increases.

The inventor of the present disclosure endeavored to create improved product display units with high-capacity tracks and pushers that help move the frequently sold products toward the front of the product display unit. The present inventor also observed that in certain applications of conventional product display units, the product display units are placed onto a shelf with no slope or inadequate slope such that the products in the product display units do not move by gravity toward the front of the product display unit. Accordingly, the present inventor realized that there is a need for improved product display units and improved pushers that move products to the front of the product display unit regardless of the shape of the product display unit and/or the slope of the shelf on which the product display unit is placed.

Figure 1:
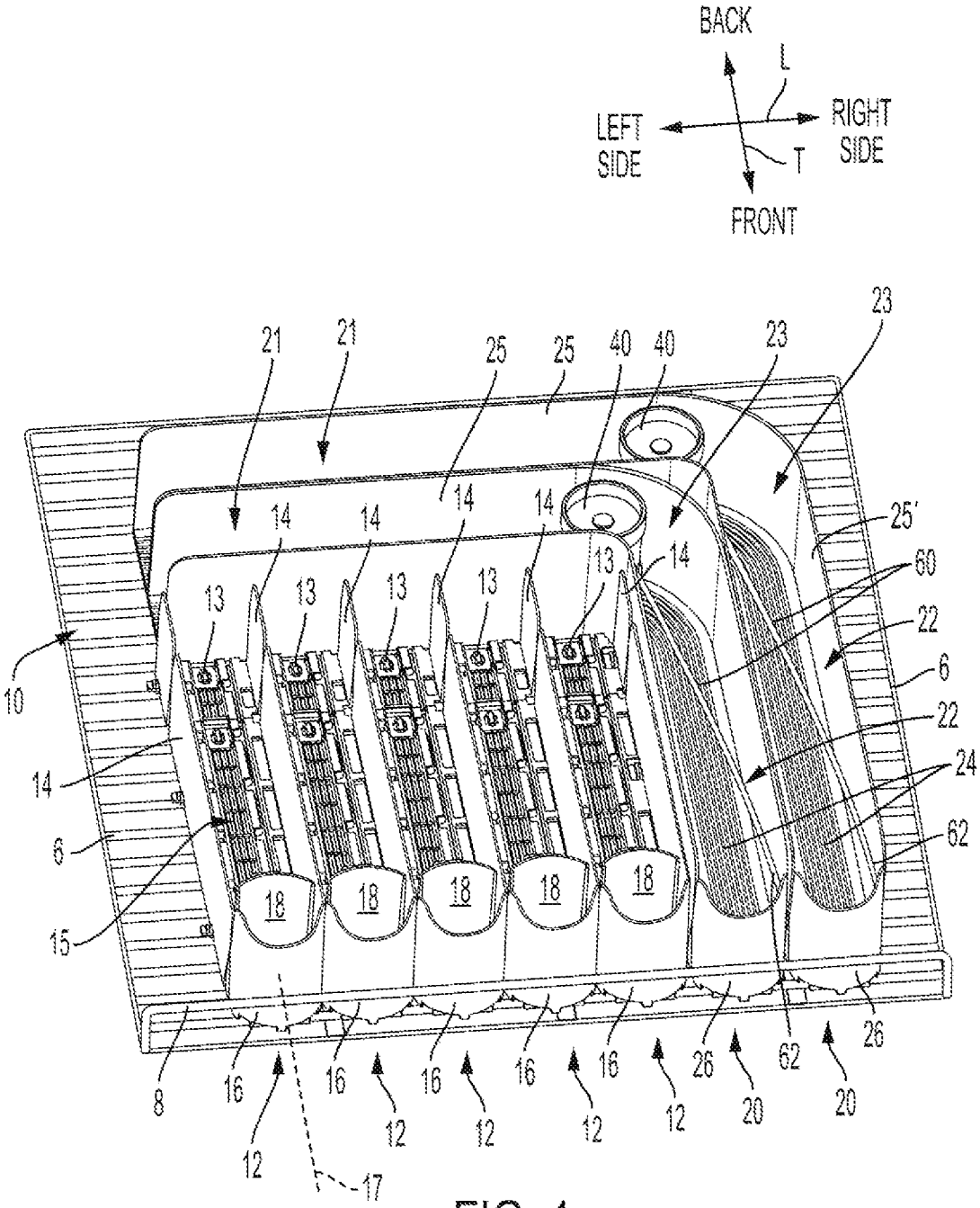
FIG. 1 is a perspective view of a product display unit according to the present disclosure.
Figure 2:
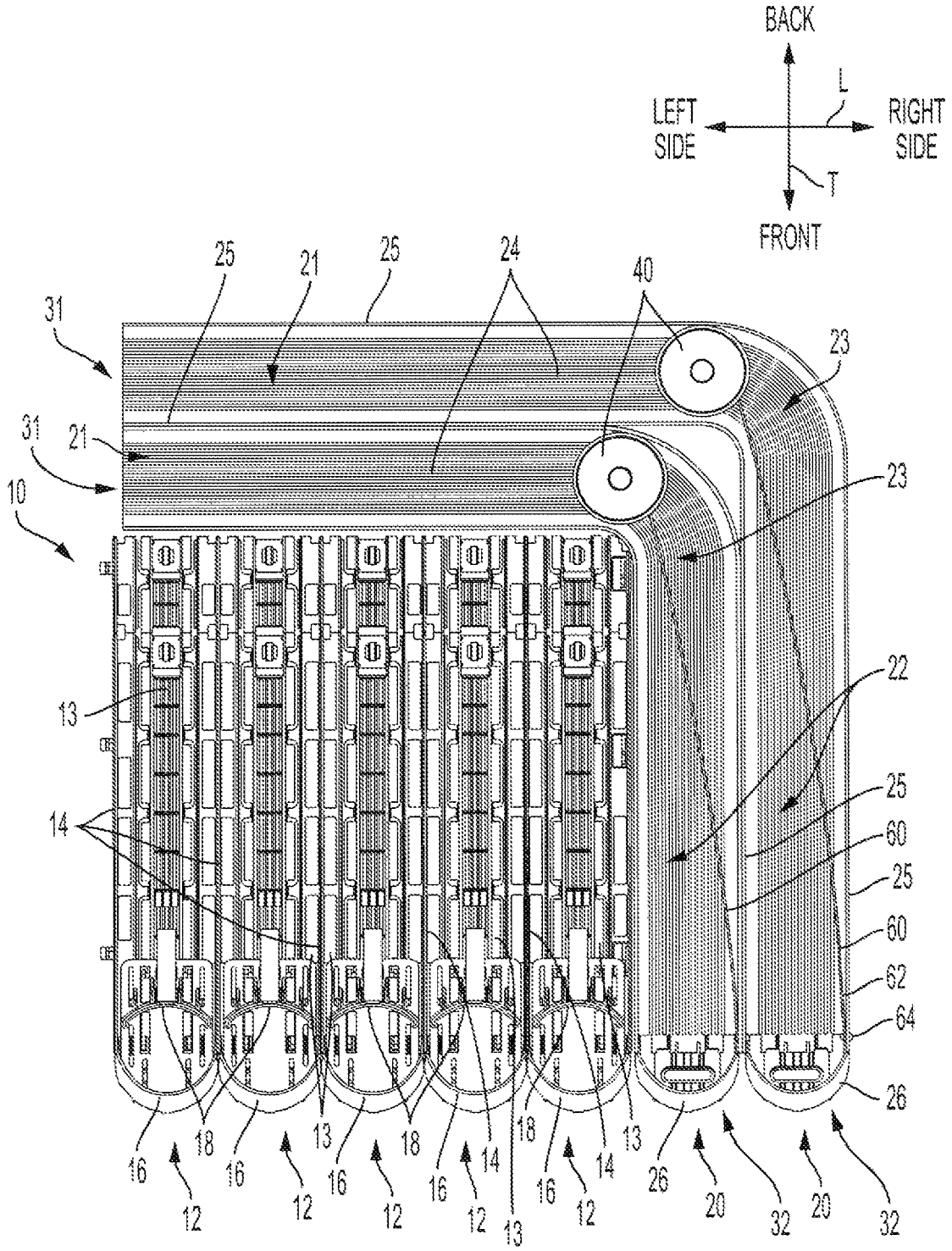
FIG. 2 is a top plan view of the product display unit of FIG. 1.

FIGS. 1-2 depict an example product display unit 10 of the present disclosure positioned on a shelf 6. The product display unit 10 includes one or more low-capacity tracks 12 that hold one or more products (not shown). Each low-capacity track 12 defines a path 15 along which the products can be moved by gravity or a pusher 18 toward the front of the product display unit 10. In the example depicted in FIGS. 1-2, the low-capacity track 12 extends along a single axis 17 such that the low-capacity tracks 12 and the path 15 are both linear. The low-capacity track 12 extends from front to back in a transverse direction (see arrow T) along the product display unit 10, and the low-capacity track 12 has a support surface 13 on which products (not shown) are supported.

The low-capacity track 12 has one or more sidewalls 14 that prevent products from inadvertently moving off the support surface 13 or into adjacent tracks. The low-capacity track 12 also has an end member 16 positioned at the front of the low-capacity track 12 to prevent products from inadvertently moving (e.g., falling) over the front of the product display unit 10. In certain examples, the end member 16 contacts and/or is braced against a lip 8 of the shelf 6.

A pusher 18 is provided at each low-capacity track 12 to move or urge products toward the front by the product display unit 10 (note that the pushers 18 are depicted near the front of the product display unit 10). The pusher 40 can be coupled to the support surface 13 or a sidewall 14. The pusher 18 is movable by an operator toward the back of the product display unit 10 such that products can be restocked into the low-capacity track 12. Reference is made to above-incorporated U.S. Pat. No. 9,392,882 for description and operational details of a conventional product display unit and a conventional pusher.

Figure 3:
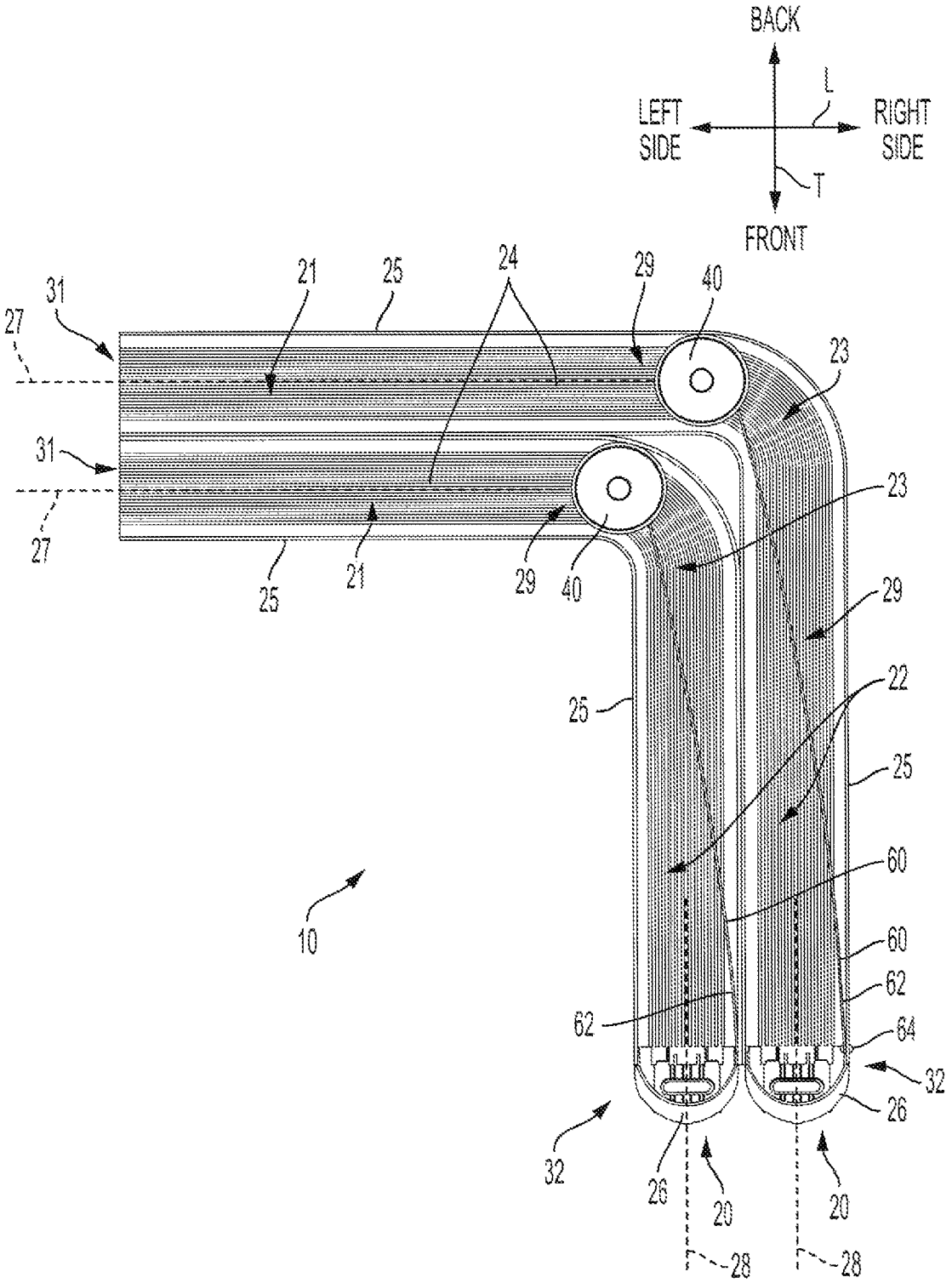
FIG. 3 is a top plan view of example high-capacity tracks of the product display unit of FIG. 2.

The product display unit 10 also includes one or more high-capacity tracks 20 (see also FIG. 3). Each high-capacity track 20 defines a path 29 (FIG. 3) along which the products can be moved by gravity and/or a pusher 40 (described herein below) toward the front of the product display unit 10. The path 29 (FIG. 3) is non-linear, and the high-capacity track 20 has a first track end 31 and a second track end 32 at the front of the product display unit 10. The locations of the first track end 31 and/or the second track end 32 can vary, and in the example depicted in FIGS. 1-2, the first track end 31 is at the left side of the product display unit 10 near the back. The shape of the path 29 can vary (e.g., the path 29 is curved, the path 29 is "L"-shaped, the path 29 is "C"-shaped, the path 29 is serpentine shaped, the path 29 extends along multiple axes).

Referring specifically to FIG. 3, each example high-capacity track 20 has a first leg 21 that extends along a first axis 27 from side (e.g., left side) to side (e.g., right side) in a lateral direction (see arrow L) that is perpendicular to the transverse direction (see arrow T). The high-capacity track 20 has a second leg 22 that extends along a second axis 28 from the front to back in the transverse direction (see arrow T). Each high-capacity track 20 has a product support surface 24 on which products (not shown) are supported. The product support surface 24 continuously extends between the first track end 31 and the second track end 32 and along the first leg 21 and the second leg 22 such that products smoothly move along the path 29. Opposing sidewalls 25 along the sides of the high-capacity tracks 20 separate the high-capacity tracks 20 from each other and other adjacent tracks. The sidewalls 25 prevent products from inadvertently moving off the product support surface 24, off the product display unit 10, and/or into adjacent tracks. The high-capacity track 20 includes an end member 26 that prevents products from inadvertently moving (e.g., falling) off the product support surface 24 and over the front of the product display unit 10. The sidewalls 25 of the high-capacity track 20 can be independent or integral with the sidewalls of adjacent tracks, such as the sidewalls 14 of the low-capacity tracks 12.

The shape and length of the high-capacity tracks 20 can vary such that the shape of the path 29 defined by the high-capacity track 20 also varies. In the example depicted in FIG. 3, the high-capacity track 20 is generally "L"-shaped having a curved transition section 23 between the first leg 21 and the second leg 22. In this example, the first leg 21 and the second leg 22 form a 90-degree angle. In other examples, the transition section 23 is excluded from the track 20 and the legs 21, 22 are directly connected to each other. The legs 21, 22 can also be orientated relative to each other at any other suitable angle (e.g., 45 degrees, 60 degrees). In still other examples, the high-capacity track 20 may have more than two legs 21, 22 and/or more than one transition sections 23. In certain examples, the high-capacity track 20, or sections thereof, can be curved (e.g., "C"-shaped, "S"-shaped). The high-capacity tracks 20 are removably coupled to each other and/or the low-capacity tracks 12 with fasteners such as bolts, dove-tail connections, rivets, detents and projections, and the like. Adhesives, such as glue or tape, can also be used to connect the tracks 12, 20.

As noted above, a pusher 40 provided at each high-capacity track 20 moves products in the high-capacity track 20 toward the front of the product display unit 10. For instance, the pusher 40 moves along the non-linear path 29 from the first track end 31 to the second track end 32 to thereby move or urge products on the product support surface 24 toward the front of the product display unit 10. The type and size of the pusher 40 can vary based on the product display unit 10, the application of the product display unit 10, and/or the size, shape, or type of products positioned in the product display unit 10. Example pushers 40 of the present disclosure are described herein below.

Figure 4:
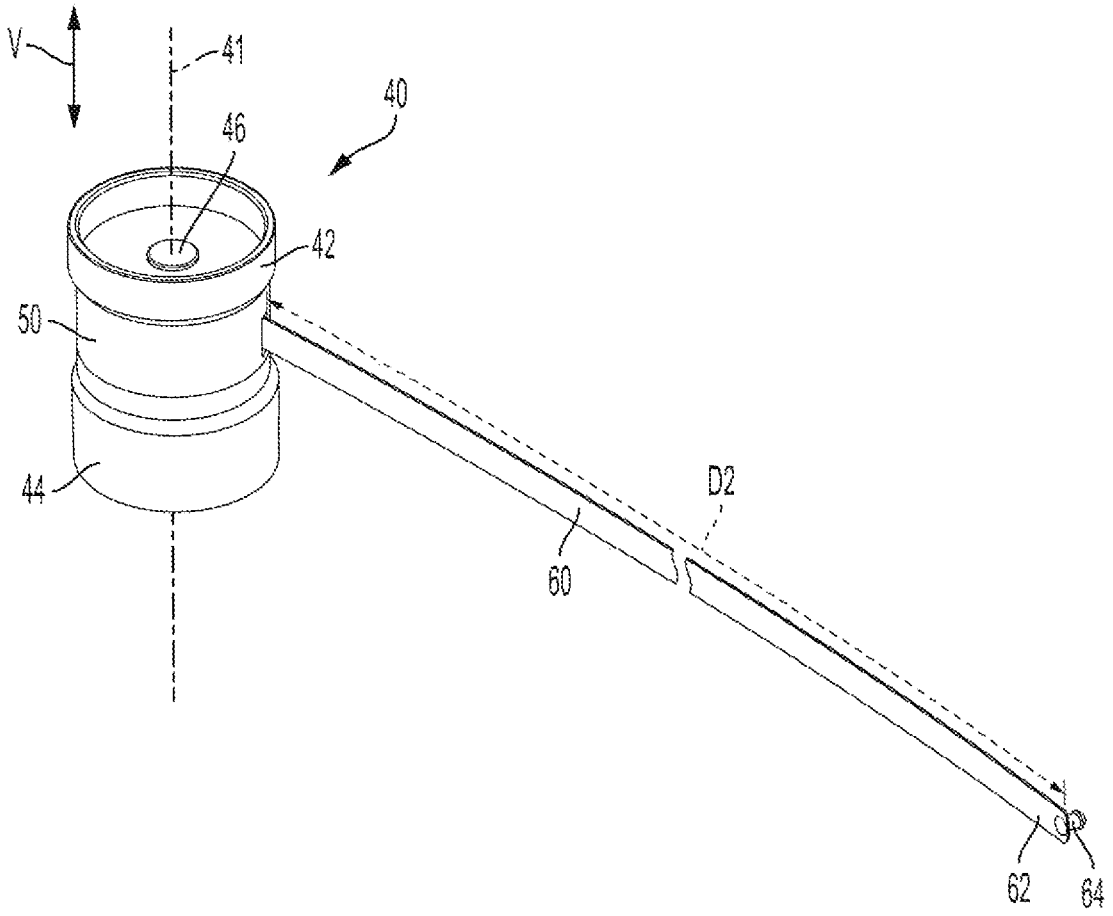
FIG. 4 is a perspective view of an example pusher according to the present disclosure.
Figure 5:
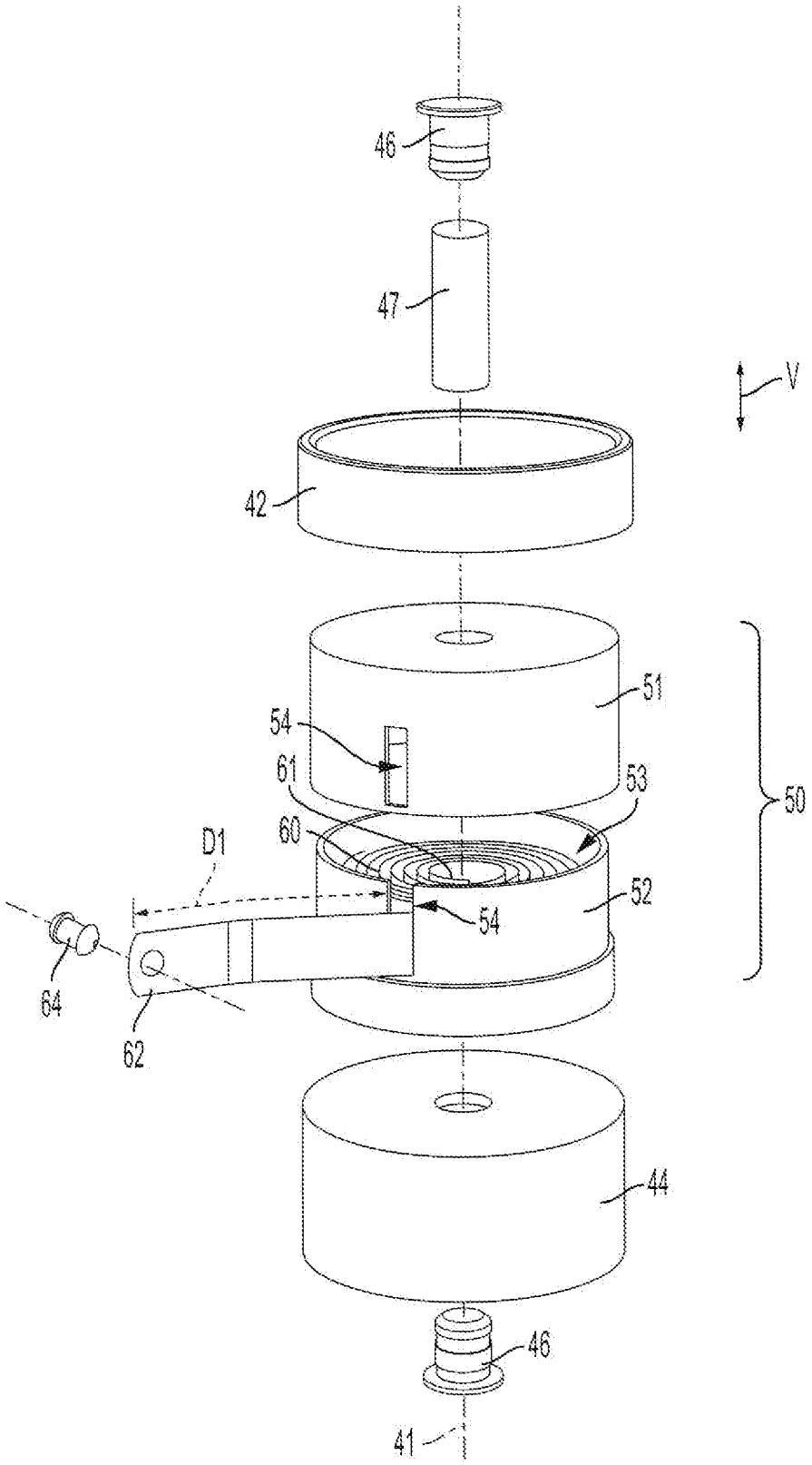
FIG. 5 is an exploded view of the pusher of FIG. 4.

FIGS. 4-5 depicts an example pusher 40 of the present disclosure. The pusher 40 generally extends in a vertical direction (see arrow V) along a pusher axis 41. In this example, the pusher 40 is generally cylindrically shaped. When the pusher 40 is in the high-capacity track 20 (see FIGS. 1 and 3), the pusher axis 41 extends transverse to the product support surface 24. The pusher 40 has a first wheel 42, a second wheel 44, and a housing 50 in which a biasing device, such as a spring 60 is positioned. The housing 50 is sandwiched between the wheels 42, 44, and the wheels 42, 44 are rotatably coupled to the housing 50 with fasteners, such as plugs 46. As such, the wheels 42, 44 rotate about the pusher axis 41 and independently of each other and/or the housing 50. In certain examples, an axle 47 (FIG. 5) that extends along the pusher axis 41 extends through the wheels 42, 44 and the housing 50 to thereby join the wheels 42, 44 and the housing 50 of the pusher 40. In certain examples, a thrust bearing (not shown) is included at or integrally molded with the wheels 42, 44 to reduce the tendency of the wheels 42, 44 to impart braking forces during rotation that would otherwise cause braking of the wheels 42, 44.

Referring specifically to FIG. 5, the housing 50 defines a cavity 53 in which the spring 60 (e.g., coil spring, constant force spring) is positioned. The housing 50 has two separable housing members, namely a first housing member 51 and a second housing member 52, such that the spring 60 can be received into and/or removed from the housing 50. The housing members 51, 52 have cutouts or openings 54 that align with each other such that an end of the spring 60 and/or a portion of the spring 60 can move through the openings 54. In certain examples, the spring 60 has a spring force of 10.0-15.0 pounds per square foot. In one specific example, the spring 60 has a spring force of 13.5 pounds per square foot. In other examples, the biasing device is a retractable tether unit.

The spring 60 has a first end 61 in the housing 50 and a second end 62 that extends out of the housing 50 through the openings 54 of the housing members 51, 52. The first end 61 of the spring 60 is coiled in the housing 50, and in certain examples the first end 61 is coiled about the pusher axis 41 such that the first end 61 freely rotates relative to the pusher axis 41. In other examples, the spring 60 is coiled about a different axis that extends transverse to the pusher axis 41.

The second end 62 of the spring 60 is connected to high-capacity track 20, and in certain examples, the second end 62 is connected to a sidewall 25 (FIG. 3). Referring back to FIG. 3, the second end 62 of the spring 60 is connected to the sidewall 25 with a fastener 64 (FIG. 8), such as nut and bolt, pin, or rivet. Note that the spring 60 extends out of the housing 50 to the second end 62 (see FIG. 3). That is, the spring 60 is partially unwound and is in an extended position which the second end 62 of the spring 60 extends a second distance D2 from the housing 50 (see FIG. 4). A person of ordinary skill in the art will recognize that the second distance D2 varies and changes based on the position and movement of the pusher 40 in the high-capacity track 20. When the housing 50 is near the second track end 32 (see also FIG. 11), the spring 60 is in a retracted position such that the second end 62 is a first distance D1 (see FIG. 5) from the housing 50. In this position, a majority of the spring 60 is wound in the housing 50. Note that the second distance D2 (FIG. 4) is greater than the first distance D1 (FIG. 5). Also, note that when the spring 60 is in the extended position (FIG. 4), the spring 60 biases the pusher 40 toward the second track end 32 (FIG. 3) based on the spring force of the spring 60 and the tendency of the spring 60 to move toward the retracted position (FIG. 5).

Figure 6:
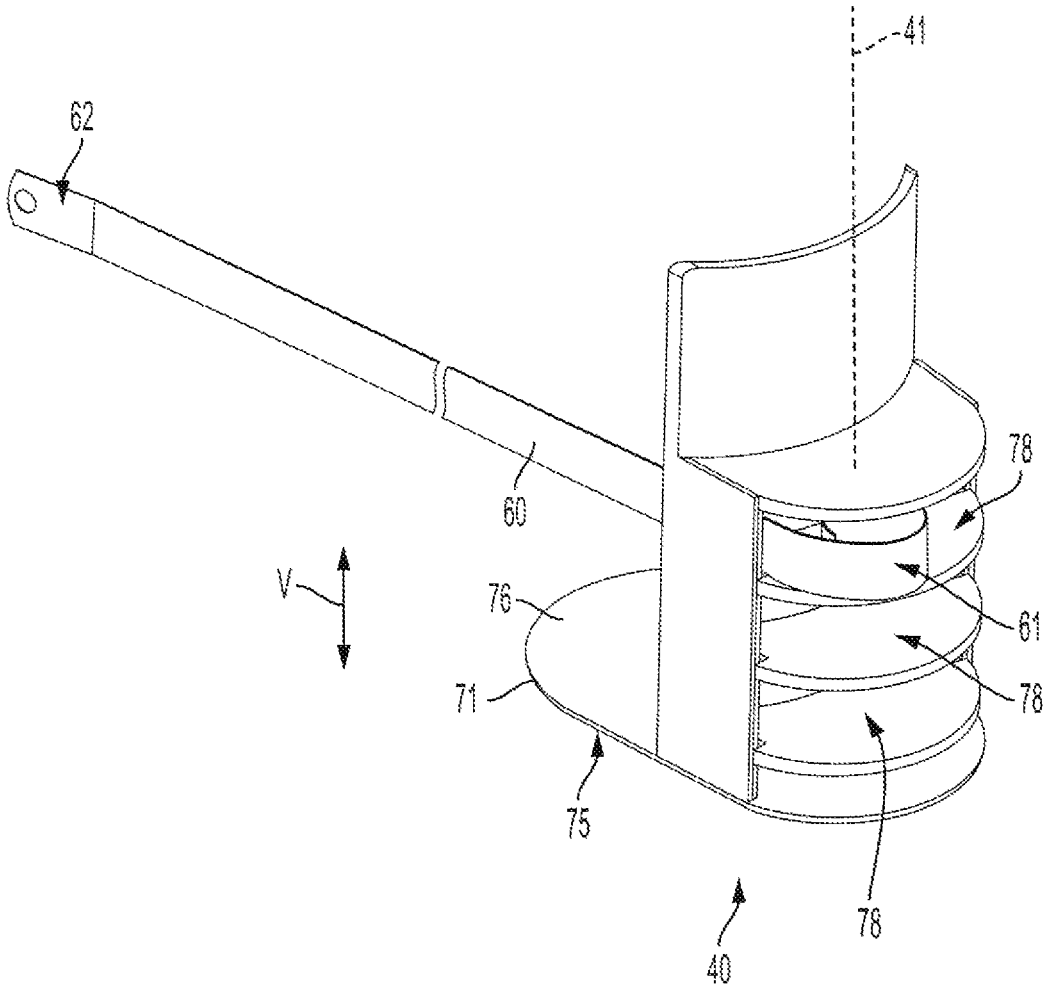
FIGS. 6-7 are perspective views of another example pusher of the present disclosure.
Figure 7:
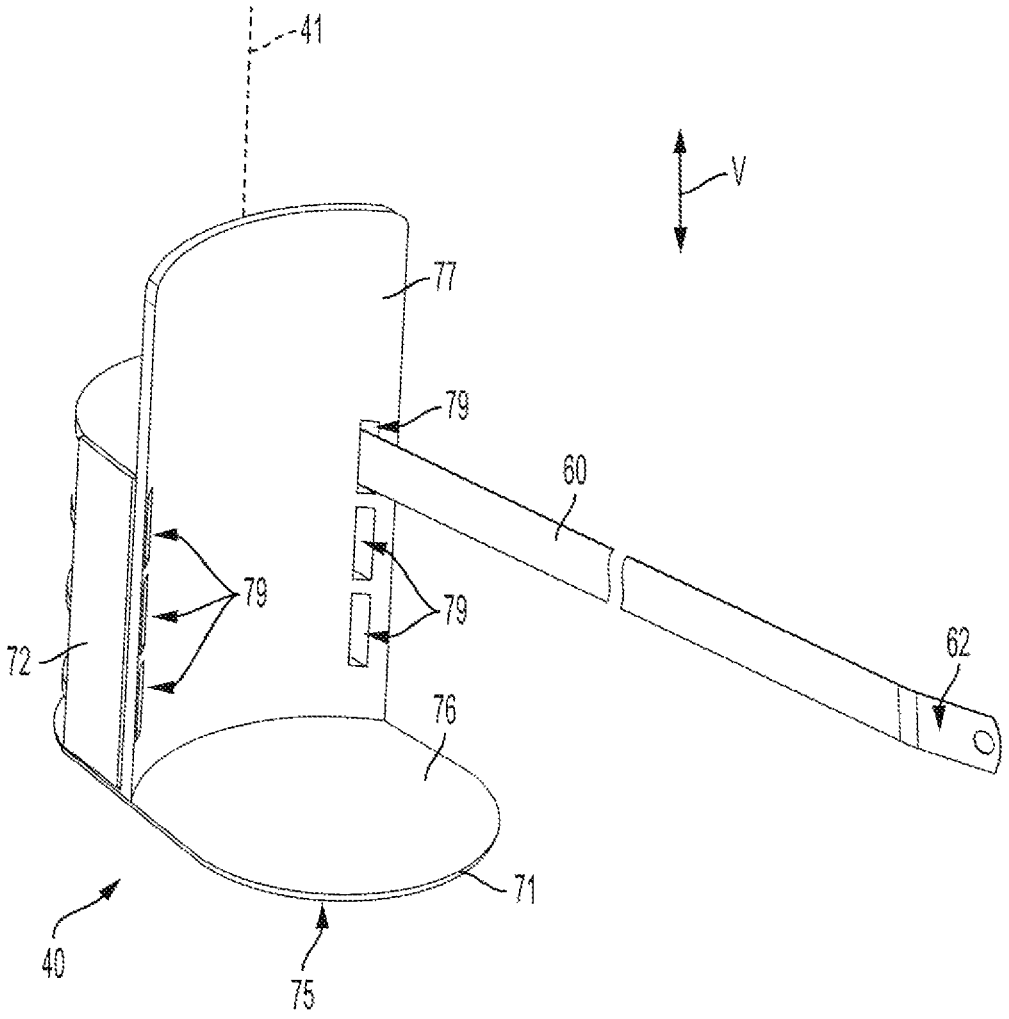

FIGS. 6-7 depict another example pusher 40 of the present disclosure. The pusher has a base 71 and a body 72 that extends away from the base 71 in the vertical direction (see arrow V). The base 71 has a bottom surface 75 that slides along and/or contacts the product support surface 24 of the high-capacity track 20 (FIG. 3) and an opposite top surface 76 on which a product (not shown) can be positioned. The body 72 has a product contact surface 77 that contacts a product (e.g., a product placed on the top surface 76 contacts the product contact surface 77). The body 72 has a plurality of slots 78 (see FIG. 6) in which the spring 60 can be positioned. The body 72 also has a plurality of holes 79 that each extend between the product contact surface 77 and one of the slots 78. Thus, the second end 62 of the spring 60 can extend through one of the holes 79 and the first end 61 of the spring 60 is coiled in the corresponding slot 78. FIGS. 6-7 depict the pusher 40 with three slots 78 stacked relative to each other and along the pusher axis 41. The pusher 40 also has three pairs of holes 79, and each pair of holes 79 corresponds to a slot 78. Note that FIGS. 6-7 depict the spring 60 in an extended position.

During setup or installation of the product display unit 10, the operator can position the spring 60 in any of the slots 78. The operator then pulls the second end 62 of the spring 60 through the corresponding hole 79 and attaches the second end 62 of the spring 60 to the track 20. The operator may select a certain slot 78 in which to locate the spring 60 for any number of responses. For example, the operator may select the slot 78 that best vertically aligns with the connection point of the second end 62 to the track 20. In another example, the operator may select the slot 78 based on the size and/or shape of the product in the track 20. In still another example, the operator may select the slot 78 that causes the spring force in the spring 60 to effectively and efficiently move the products in the track 20 toward the front of the product display unit 10 (e.g., locating the spring 60 in the uppermost slot 78 may cause the more forward rotational movement of the pusher 40 than when the spring 60 is located in the lowermost slot 78). Note that the example pushers 40 described herein above could be used in the low-capacity tracks 12.

Operation of an example pusher 40 of the present disclosure that moves products toward the second track end 32 is described herein below with reference to FIGS. 8-11. Note that a single high-capacity track 20 is shown for clarity and several products P1-P14 are positioned in the path 29 defined by the track 20.

Figure 8:
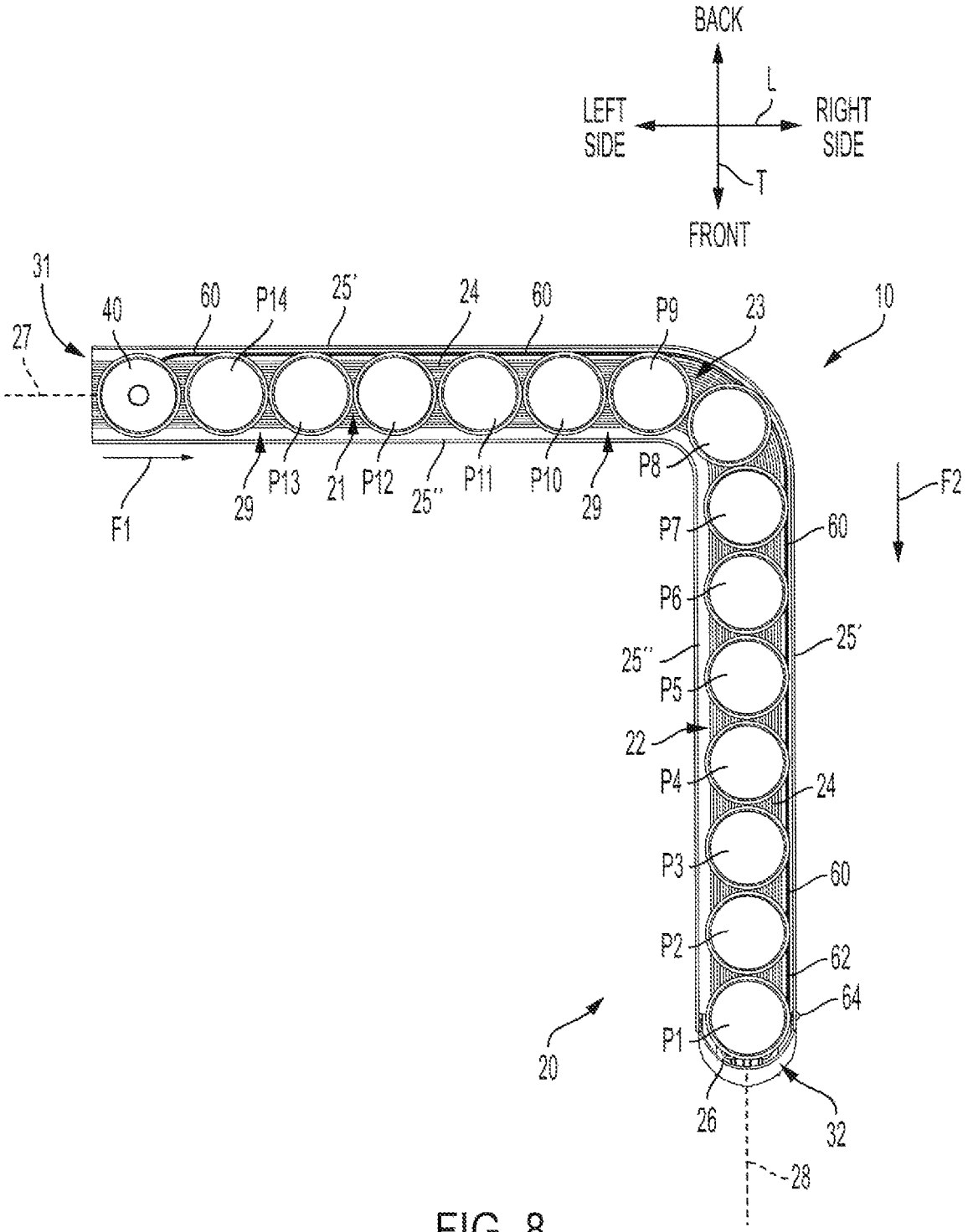
FIGS. 8-11 depict an example pusher moving products along a track as products are removed from the track.

FIG. 8 depicts the high-capacity track 20 loaded with fourteen products P1-P14. The pusher 40 is positioned on the first leg 21 of the high-capacity track 20 at the back left side of the product display unit 10. The spring 60 is in the extended position (see FIG. 4) and the second end 62 of the spring 60 is connected to the outer sidewall 25' with a fastener 64. The first end 61 of the spring 60 is in the housing 50 (see FIG. 5) or in one of the slots 78 (FIG. 6). As such, the spring force of the spring 60 biases the pusher 40 toward the second end 62 of the product display unit 10. Thus, the pusher 40 acts and/or contacts product P14. For example, the wheels 42, 44 of the pusher 40 depicted in FIGS. 4-5 contact product P14. In another example, the product contact surface 77 of the pusher 40 depicted in FIGS. 6-7 contacts product P14. As such, the pusher 40 urges product P9-P14 in the lateral direction (see arrow F1) and products P1-P8 in the transverse direction (see arrow F2). Each product P1-P14 is in contact with adjacent products P1-14 and all the products P1-P14 are urged toward the end member 26, the second track end 32, and the front of the product display unit 10. Note that the products P1-P14 push the extended portion of the spring 60 along or against the outer sidewall 25'.

Figure 9:
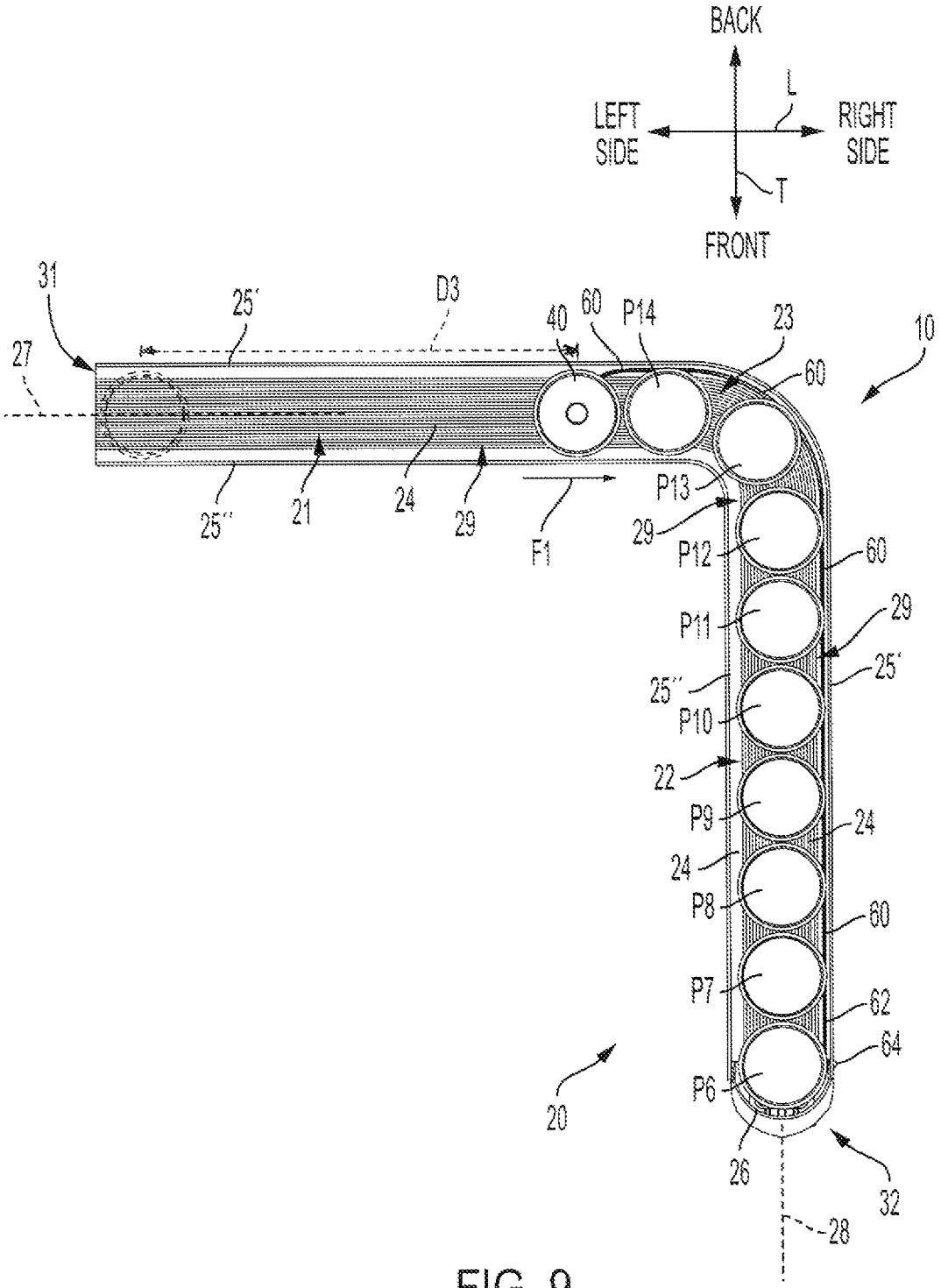

Now referring to FIG. 9, products P1-P5 (see FIG. 8) are removed from the high-capacity track 20 by the customer and the remaining products P6-P14 are depicted moved toward the front of the product display unit 10. That is, as the products P1-P5 are removed from the high-capacity track 20, the pusher 40 moves away from the first track end 31 (see FIG. 8) and urges the remaining products toward the second track end 32. In this example, the pusher 40 moves in the lateral direction (see arrow F1) as the product P1-P5 are removed. As the pusher 40 moves, a length of the spring 60 winds up into the pusher 40 due to the spring force of the spring 60. Note that the length of the spring 60 that winds up into the housing 50 (FIG. 5) or the slot 78 (FIG. 6) is equivalent to the distance (see distance D3) the pusher 40 moves along the high-capacity track 20. Note that the previous positions of the pusher 40 (e.g., the position of the pusher 40 depicted in FIG. 8) is indicated in dashed lines).

Figure 10:
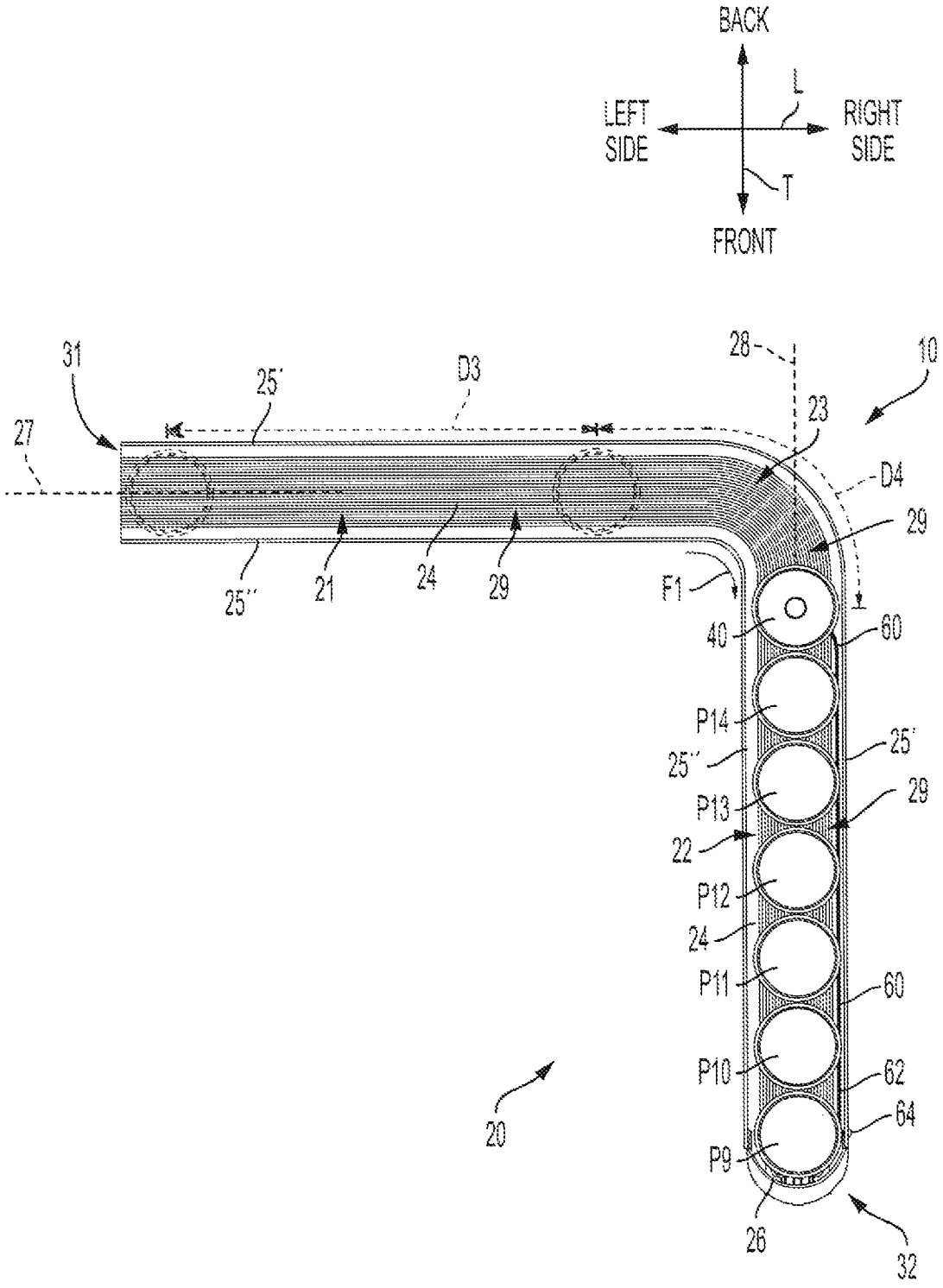

Referring to FIG. 10, products P6-P8 (see FIG. 9) are removed from the high-capacity track 20 and the remaining products P9-P14 are depicted moved toward the front of the product display unit 10. That is, as the products P6-P8 are removed, the pusher 40 continues to move along the track 20 and urge the products toward the second track end 32. In particular, the pusher 40 moves along the path 29 through the transition section 23 (see arrow F1) and further moves in the transverse direction (see direction arrow T) into the second leg 22. An additional length of the spring 60 (see distance D4) winds up into the housing 50 (FIG. 5) or the slot 78 (FIG. 6).

Figure 11:
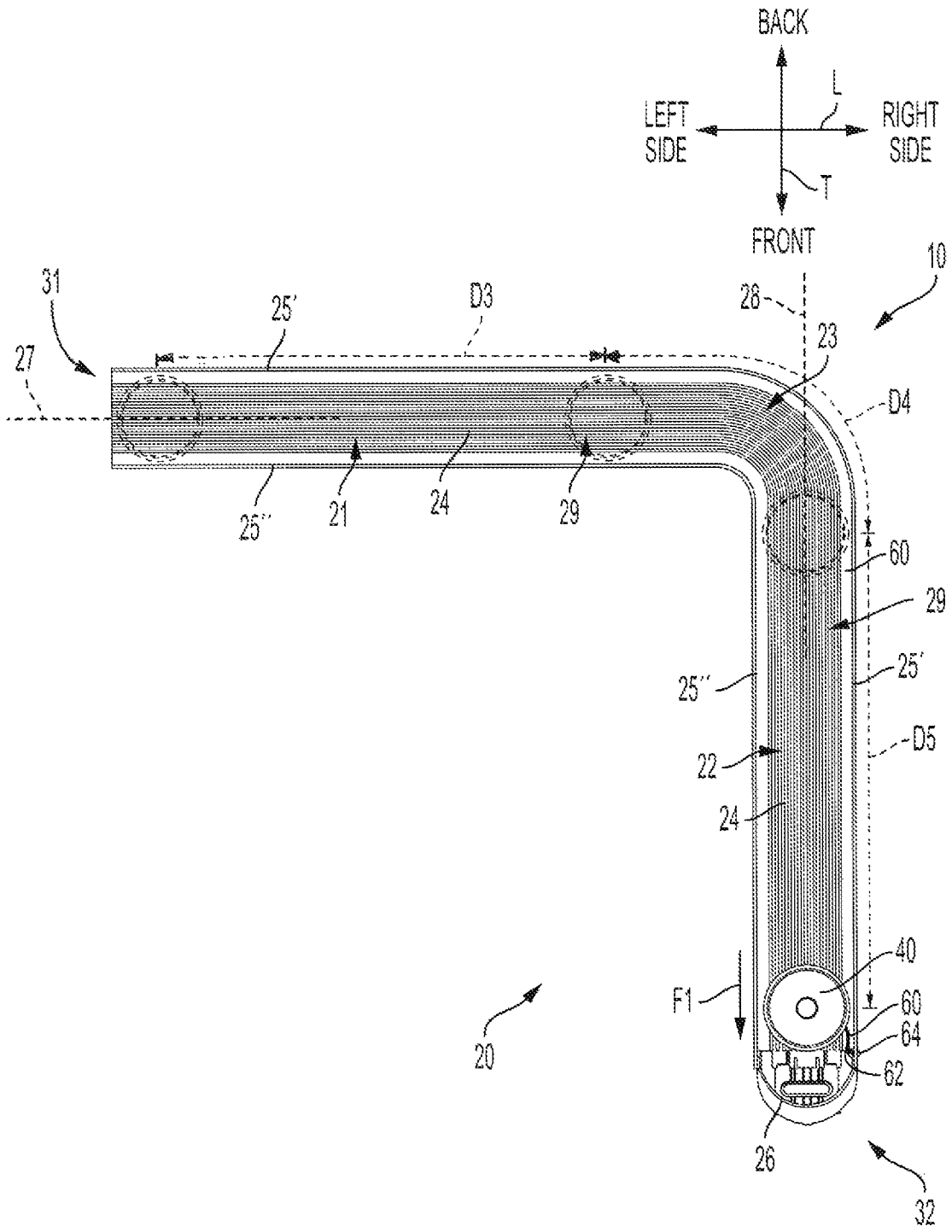

Referring now to FIG. 11, the remaining products P9-P14 (see FIG. 10) are removed from the high-capacity track 20 by the customer and the pusher 40 is depicted at the second track end 32 and adjacent to the end member 26. The spring 60 is in the retracted position (see also FIG. 5). An additional length of the spring 60 (see distance D5) winds up into the housing 50 (FIG. 5) or the slot 78 (FIG. 6).

To restock the high-capacity track 20 with new products, the employee inserts the products into the high-capacity track 20 at the second track end 32 such that each inserted product moves the pusher 40 toward the first track end 31. Simultaneously, the spring 60 unwinds and moves away from the retracted position (FIG. 5) toward the extended position (FIG. 4).

In certain examples, as the pusher 40 moves along the path 29 (as described above with respect to FIGS. 8-11), the pusher 40 rotates about the pusher axis 41 (FIGS. 4 and 6). For example, the pusher 40 rotates about the pusher axis 41 as the pusher 40 moves through the transition section 23. In another non-limiting example, the pusher 40 depicted in FIGS. 6-7 rotates as the pusher 40 moves between the first leg 21 and the second leg 22 (see FIGS. 9-10). That is, when the pusher 40 is along the first leg 21 (FIG. 9), the pusher 40 is generally in a first position in which the product contact surface 77 (FIG. 7) extends transverse to the second axis 28 (e.g., the product contact surface 77 extends in the lateral direction). As the pusher 40 moves through the transition section 23 and into the second leg 22, the pusher 40 rotates about the pusher axis 41 into a second position in which the product contact surface 77 (FIG. 7) extends transverse to the first axis 27 (e.g., the product contact surface 77 extends in the transverse direction).

Furthermore, in certain examples, the pusher 40 can slightly move side-to-side between the sidewalls 25', 25" and/or rotate slightly, back-and-forth, about its pusher axis 41 (FIG. 4) as the pusher 40 moves along the first leg 21 or the second leg 22 (FIG. 8-11). These slight movements prevent the pusher 40 from becoming stuck in the high-capacity track 20. In addition, these slight movements prevent the products becoming stuck or "binding" against the sidewalls 25', 25", the other products P1-P14, and/or the pusher 40. In addition, components of the pusher 40, such as the wheels 42, 44 of the example pusher 40 depicted in FIGS. 4-5, rotate to further prevent "binding" of the products in the high-capacity track 20.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A product display unit for displaying products, the product display unit comprising:

a track defining a path configured to receive the products, the path extends between a first track end and a second track end; and a pusher having:

a spring that biases the pusher toward the second track end such that the pusher is configured to move the products toward the second track end; and a wheel configured act on one of the products and rotate as the pusher moves the products along the path;

wherein the track has a first leg and a second leg that extends transverse to the first leg, and wherein the pusher moves along the first leg and the second leg.

2. The product display unit according to claim 1, wherein the pusher extends along a pusher axis, and wherein the wheel freely rotates about the pusher axis.

3. The product display unit according to claim 2, wherein the track has a product support surface configured to support the products, and wherein the pusher axis extends transverse to the product support surface.

4. The product display unit according to claim 1, wherein the pusher has a housing in which a first end of the spring is positioned, and wherein a second end of the spring is connected to the track.

5. The product display unit according to claim 4, wherein the track has a product support surface configured to vertically support the products, and wherein the wheel and the housing are vertically above the product support surface.

6. The product display unit according to claim 1, wherein the track is L-shaped.

7. The product display unit according to claim 1, wherein the first leg extends along a first axis and the second leg extends along a second axis that is transverse to the first axis.

8. The product display unit according to claim 7, wherein the track has a curved transition section that connects the first leg to the second leg.

9. The product display unit according to claim 1, wherein the pusher has a spring with a first end at the pusher and a second end connected to the track.

10. The product display unit according to claim 9, wherein the pusher defines a pusher axis about which the first end of the spring is coiled.

11. The product display unit according to claim 4, wherein the wheel is a first wheel, and wherein the pusher further includes a second wheel configured act on the one of the products and rotate as the pusher moves along the path.

12. The product display unit according to claim 11, wherein the housing is between the first wheel and the second wheel.

13. The product display unit according to claim 11, wherein the track has a product support surface configured to vertically support the products, and wherein the first wheel, the second wheel, and the housing are vertically above the product support surface.

14. A product display unit for displaying products, the product display unit comprising:

a track defining a path configured to receive the products, the path extends between a first track end and a second track end; and a pusher having:

a spring that biases the pusher toward the second track end such that the pusher is configured to move the products toward the second track end; and a wheel configured act on one of the products and rotate as the pusher moves the products along the path;

wherein the pusher has a housing in which a first end of the spring is positioned, and wherein a second end of the spring is connected to the track;

wherein the wheel is a first wheel, and wherein the pusher further includes a second wheel configured act on the one of the products and rotate as the pusher moves along the path; and wherein as the pusher moves along the track, the first wheel and the second wheel rotate independently of each other and the housing.

15. A product display unit for displaying products, the product display unit comprising:

a track defining a non-linear path; and a pusher that moves along the non-linear path and is configured to move the products along the non-linear path;

wherein the pusher extends along a pusher axis and has a first wheel and a second wheel that rotate about the pusher axis, and wherein the first wheel and the second wheel rotate as the pusher moves the products;

wherein the pusher has a spring with a first end and a second end connected to the track and a housing in which the first end of the spring is positioned, and wherein the housing is sandwiched between the first wheel and the second wheel.

16. A product display unit for displaying products, the product display unit comprising:

a track defining a non-linear path; and a pusher that moves along the non-linear path and is configured to move the products along the non-linear path;

wherein the pusher extends along a pusher axis, and wherein the pusher has:

a spring with a first end and a second end connected to the track;

plurality of slots stacked relative to each other along the pusher axis, wherein the first end of the spring is received in one of the plurality of slots;

a product contact surface configured to contact one of the products; and a plurality of holes that each extend between the product contact surface and one of the plurality of the slots; and wherein the spring extends through the hole that corresponds to the slot the first end of the spring is received.

* * * * *